US006530641B2

(12) United States Patent
Ohashi et al.

(10) Patent No.: US 6,530,641 B2
(45) Date of Patent: Mar. 11, 2003

(54) LIQUID DISCHARGE HEAD UNIT, HEAD CARTRIDGE, AND METHOD FOR MANUFACTURING LIQUID DISCHARGE HEAD UNIT

(75) Inventors: Tetsuya Ohashi, Chiba (JP); Yutaka Koizumi, Kanagawa (JP); Hiroyuki Kigami, Kanagawa (JP); Takayuki Ono, Kanagawa (JP); Satoshi Shimazu, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 31 days.

(21) Appl. No.: 09/941,776

(22) Filed: Aug. 30, 2001

(65) Prior Publication Data

US 2002/0033857 A1 Mar. 21, 2002

(30) Foreign Application Priority Data

Sep. 4, 2000 (JP) ..... 2000-267801

(51) Int. Cl.[7] ..... B41J 2/01
(52) U.S. Cl. ..... 347/20
(58) Field of Search ..... 347/20, 49, 50, 347/63, 87, 108, 47, 65; 400/175; 29/890.1; 430/320

(56) References Cited

U.S. PATENT DOCUMENTS

| | | | | | |
|---|---|---|---|---|---|
| 4,343,013 | A | * | 8/1982 | Bader et al. | 347/45 |
| 4,570,167 | A | * | 2/1986 | Sugitani et al. | 347/65 |
| 4,570,168 | A | * | 2/1986 | Sjordal et al. | 346/145 |
| 5,534,898 | A | * | 7/1996 | Kashino et al. | 347/33 |
| 6,045,216 | A | * | 4/2000 | Sasaki | 347/49 |

FOREIGN PATENT DOCUMENTS

| | | | | |
|---|---|---|---|---|
| EP | 995601 A2 | * | 4/2000 | B41J/2/14 |
| JP | 57-107850 | * | 6/1982 | B41J/3/04 |

OTHER PUBLICATIONS

U.S. patent application Ser. No. 09/428,449, filed Oct. 28, 1999.

U.S. patent application Ser. No. 09/941,775, filed Aug. 30, 2001.

* cited by examiner

*Primary Examiner*—John Barlow
*Assistant Examiner*—Blaise Mouttet
(74) *Attorney, Agent, or Firm*—Fitzpatrick, Cella, Harper & Scinto

(57) ABSTRACT

A liquid discharge head unit wherein the position of the discharge ports are arranged in high precision with respect to the liquid discharge apparatus main body so that the liquid discharge head unit is capable of executing highly precise liquid discharges.

2 Claims, 8 Drawing Sheets

LIQUID DISCHARGE HEAD UNIT, HEAD CARTRIDGE, AND METHOD FOR MANUFACTURING LIQUID DISCHARGE HEAD UNIT

BACKGROUND OF THE INVENTION

1. Field of the Invention

The present invention relates to a liquid discharge head unit used for a liquid discharge apparatus that performs recording operation by discharging liquid, such as ink, from discharge ports in the form of liquid droplets. The invention also relates to a head cartridge and a method for manufacturing a liquid discharge head unit as well. In this respect, the liquid discharge head unit of the invention is applicable to a copying machine, a facsimile equipment having communication systems, a word processor having a printing unit, besides a printing apparatus generally used. Further, the invention is applicable to a recording system for industrial use which is provided with various kinds of processing apparatuses complexly combined therein.

2. Related Background Art

The liquid discharge apparatus (ink jet recording apparatus) is a recording apparatus of the so-called non-impact recording type, which makes it possible to record on various kinds of recording mediums at high speed. With the advantages such as to make almost no noises in printing, the liquid discharge apparatus is widely adopted for a printer, a copying machine, a facsimile equipment, a word processor, or the like that carries a recording mechanism.

As the typical liquid discharge method for a liquid discharge head to be mounted on a liquid discharge apparatus of the kind, there have been known the one that uses electromechanical converting device, such as piezo-element; the one that uses the irradiation of laser or other electromagnetic waves in order to discharge liquid droplets by the heating thereof; or the one that discharges liquid droplets by the action of film boiling generated by heat given to liquid by use of electrothermal converting devices (heaters) each having a heating resistive element therefor. The liquid discharge head, which uses electrothermal converting devices as discharge energy generating elements, is provided with electrothermal converting devices arranged in the liquid flow paths, respectively, and when electric pulses are applied to them for generating heat, thermal energy is given to ink. By the utilization of the bubbling pressure of liquid at the time of bubbling (boiling) exerted by the phaseal changes of liquid then, fine liquid droplets are discharged from fine discharge ports to record on a recording medium. In general, the liquid discharge head comprises discharge ports for discharging liquid droplets, and a supply system for supplying ink to these discharge ports.

The liquid discharge apparatus that uses the electrothermal converting devices described above has advantages in that it is relatively easy to perform image recording in high image quality and in high precision, and also, relatively easy to arrange the structure whereby to record images in colors. While the liquid discharge apparatus of the kind is being manufactured, it is demanded more to make the recording apparatus itself smaller. To meet such demand, there is used a head cartridge which is integrally formed compactly by a liquid discharge head and a liquid retaining portion that retains liquid to be supplied to the head.

The head cartridge of the kind may be provided with a liquid retaining portion capable of retaining ink of plural colors for the formation of color image or with a liquid retaining portion having liquid containers arranged to be exchangeable when ink has been consumed in order to reduce the running costs thereof. Also, it is known to use the liquid discharge head chip as a liquid discharge head which is compactly structured by bonding an orifice plate having discharge ports formed therefor to an element base plate having fine heaters, liquid flow paths, and others formed thereon. Then, this liquid discharge head chip is incorporated in the liquid discharge head unit provided with means for holding the chip in a designated position, and liquid supply means for conducting liquid from the liquid retaining portion to the liquid discharge head, among some others. This unit is bonded to the liquid retaining portion to structure a head cartridge unit. The liquid discharge head unit used for color image recording has a plurality of liquid discharge head chips incorporated in order to discharge ink of each color. Also, there may be a plurality of liquid discharge head chips incorporated in the liquid discharge head unit for the purpose of speeding up the recording operation.

However, for the liquid discharge head unit of the kind, it is required to position the liquid discharge head chip, the position of the discharge ports in particular, in high precision with respect to the liquid discharge apparatus main body so that liquid can be discharged to the appropriate positions for recording highly precise images.

Also, when the liquid discharge head unit is bonded to the liquid retaining portion or when the head unit is installed on the liquid discharge apparatus main body, there is a fear that the orifice plate is caused to be deformed or present some other defects if external force is given to the liquid discharge port formation surface, thus producing unfavorable effect on the preciseness of liquid discharges.

SUMMARY OF THE INVENTION

Therefore, the present invention aims at the provision of a liquid discharge head unit capable of positioning the discharge ports to a liquid discharge apparatus main body in high precision for executing highly precise liquid discharges, and also, aims at the provision of a head cartridge, as well as a method for manufacturing such liquid discharge head unit.

Also, it is another object of the present invention to provide a liquid discharge head unit capable of preventing external force from being exerted on the liquid discharge formation surface in order to avoid producing adverse effect on the preciseness of liquid discharges, and also, to provide a head cartridge, as well as a method for manufacturing such liquid discharge head unit.

In order to achieve these objects, the liquid discharge head unit of the present invention comprises a base plate having the installation reference used as positioning reference for the installation thereof on a liquid discharge apparatus main body; a frame connected to the base plate, having liquid supply paths formed therein for conducting liquid, and liquid supply ports communicated with the liquid supply paths open to side portion; a chip unit provided with discharge energy generating elements for heating the liquid to be bubbled and discharged, discharge ports for discharging the liquid, and liquid receiving ports for receiving the liquid into the interior thereof, and connected to the frame in a state of abutting against the side portion of the frame so as to enable the liquid supply ports and the liquid receiving ports to be communicated; and a front cap having opening portion to enable the discharge ports to be exposed to the outside, being arranged to cover the chip unit and the frame by covering at least the surface having the discharge ports open thereto, and connected to the chip unit and the frame.

With the structure thus arranged, the frame abuts against the base plate to be connected to the base plate in a state where the frame is in the relative positions designated for the installation reference, and further, the chip unit can abut against the side portion of this frame to be connected to the frame in a state of being in the relative positions designated for the installation reference, hence making it easier to position the discharge ports open to the chip unit in high precision with respect to the installation reference. Consequently, the position of the discharge ports can be arranged in high precision with respect to the liquid discharge apparatus main body to make it possible to structure a liquid discharge head unit capable of executing highly precise liquid discharges.

Also, with the provision of the front cap, it becomes possible to protect the liquid discharge surface from the external force that may be exerted on the discharge port formation surface, and avoid the adverse effect that may be produced by external force on the preciseness of liquid discharges. For the front cap, too, it is easier to make connection in a state of being in the relative positions designated for the installation reference. In this way, the front cap is prevented from being in contact with a recording medium.

The liquid discharge head is characterized in that the frame, the chip unit, and the front cap are arranged in relative positions designated for the installation reference.

If the frame is connected with the base plate by use of screws, it becomes possible to remove the screws and arrange the face again for connection in a case where the installation reference and the relative positions are found to be deviated after the frame has been connected. In this manner, these can be positioned and connected in higher precision.

If the frame is formed by ceramic, it becomes possible to perform a highly precise machining accompanied by process heating, because ceramic has a small thermal expansion. The abutting surface, the installation referential surface, and the like for the base plate and chip unit can be processed with high surface precision to enable each member to be arranged in high precision. Also, it becomes possible to prevent the frame from being deformed, thus suppressing the positional displacement of discharge ports due to heat or the like generated by driving discharge energy generating elements.

Also, it is possible to effectively obtain a protective function not to exert external force on the discharge port formation surface by positioning the surface of the front cap having the opening portion open thereto more in front in the direction of the liquid discharges than the surface of the chip unit having the discharge ports open thereto.

Further, in the case where the chip unit is provided with a flat type orifice plate having the discharge ports open thereto, which is connected to the other portions of the chip unit, if the size of the opening portion is smaller than the size of the orifice plate, and the front cap covers the upper side portion of the orifice plate, it becomes possible to prevent the orifice plate from being peeled off by not allowing any force to be exerted on the side portion of the orifice plate when liquid (ink) or the like adhering to the liquid discharge surface is removed by use of a blade.

It is possible to bond the front cap on the designated position easily by arranging, on the side face portions of the surface of the front cap having the opening portion open thereto, holes for use of UV bonding agent with narrower portions formed on the way near the front edge portions thereof and extended forwardly from the rear edge portion of the frame in the direction toward the surface having the opening portion open thereto, and by coating UV bonding agent on the portions having the parts more in front than the narrower portions of the holes for use of bonding agent positioned on the side face portions of the frame, before the front cap is arranged on the designated position, and subsequently, arranging the front cap on the designated position for hardening the UV agent by the irradiation of UV rays through the holes for use of bonding agent. Also, since the UV agent is hardened inside the portion more in front than the narrower portion of the hole for use of bonding agent, it is made possible to keep the front cap firmly stationary even if a load is given in the direction perpendicular to the surface having the opening portion open thereto, because the hardened bonding agent stays on the edge of the hole for use of bonding agent.

It is preferable to give a water repellent treatment to the surface of the front cap having the opening portion open thereto so that any discharged liquid that may adhere does not flow to the liquid discharge ports to exert influence on the preciseness of liquid discharges. Particularly, it is preferable to give such repellent treatment by means of Teflon coating. In accordance with the present invention, various kinds of materials can be used for the manufacture of the front cap. Therefore, it is possible to exercise the Teflon coating that needs baking process.

The head cartridge of the present invention comprises a liquid discharge head unit referred to in the preceding paragraphs, and a liquid container portion for containing liquid to be supplied to the liquid discharge head unit.

The method of the present invention for manufacturing a liquid discharge head unit comprises the following steps of:

manufacturing a base plate having the installation reference used as positioning reference for the installation thereof on a liquid discharge apparatus main body, and a frame connected to the base plate, having liquid supply paths formed therein for conducting liquid, and liquid supply ports communicated with the liquid supply paths open to side portion;

connecting the frame in the state of abutting against the base plate and being arranged in the relative positions designated for the installation reference;

manufacturing a chip unit provided with discharge energy generating elements for heating liquid to be bubbled and discharged, discharge ports for discharging the liquid, and liquid receiving ports for receiving the liquid into the interior thereof;

connecting the frame in a state of abutting against the side portion of the frame to enable the liquid supply ports and the liquid receiving ports to be communicated;

manufacturing a front cap having opening portion to enable the discharge ports to be exposed to the outside, being configured to cover the chip unit and the frame by covering at least the surface having the discharge ports open thereto; and connecting the front cap to the chip unit and the frame in a state of covering the chip unit and the frame and being arranged to be in the relative positions designated for the installation reference.

Further, this method of manufacture is characterized in comprising the following steps of:

coating UV bonding agent, before the front cap is arranged on the designated position, on the portions of the side faces of the frame having each portion more in front of the narrower portion of the hole for use of the bonding agent at the time of being arranged on the designated position by use of the front cap provided with the hole for use of the bonding agent on the face on the side of the surface having the opening portion open thereto, being extended from the rear edge portion forwardly in the direction toward the surface having the opening portion open thereto, and having the narrower portion on the way near the front edge portion thereof;

arranging the front cap after the coating on the designated position; and irradiating after the arrangement ultraviolet rays to the UV bonding to be hardened through the hole for use of UV bonding agent.

Also, the liquid discharge head unit in accordance with another embodiment of the present invention, which is provided with a supporting member having an installation reference used for the positioning reference for the installation on a liquid discharge apparatus main body, liquid supply paths formed inside for conducting liquid, liquid supply ports communicated with the liquid supply paths, being open to the side portion; and a chip unit having discharge energy generating elements for heating the liquid to be bubbled and discharged, discharge ports for discharging the liquid, and liquid receiving ports for receiving the liquid into the inside thereof, the liquid supply ports and the liquid receiving ports being connected to be communicated in a state of abutting against the side portion of the supporting member, comprises a front cap having an opening portion to enable the discharge ports to be exposed to the outside, being arranged to cover the chip unit and the supporting member by covering at least the surface having the discharge ports open thereto, and connected to the chip unit and the supporting member, in which the chip unit is provided with a flat type orifice plate, having the discharge ports open thereto, connected to the other portion of the chip unit, and the size of the opening portion is smaller than the size of the orifice plate, and the front cap covers above the side portions of the orifice plate.

In other words, the liquid discharge head unit of the present invention is characterized particularly in that the front cap is provided to cover above the side portion of the orifice plate, whereby to obtain the function to protect the orifice plate. Therefore, the preferable structure of the front cap installation is not necessarily the one having the base pate and the frame. The structure may be formed with the provision of the chip unit and the supporting member therefor.

In this case, too, it is preferable to arrange the chip unit and the front cap in the relative positions designated for the installation reference, because with such arrangement, the precision of liquid discharges can be enhanced, and the function to protect the front cap can be obtained in a better condition.

Also, it is preferable to position the surface of the front cap having the opening portion open thereto more in front in the discharging direction of the liquid than the surface of the chip unit having the discharge ports open thereto, because with this positioning, the orifice plate can be protected effectively.

Also, it is preferable to arrange, on the side face portions of the surface of the front cap having the opening open thereto, holes for use of UV bonding agent with narrower portions formed on the way near the front edge portions, and extended forwardly from the rear edge portion of the frame in the direction toward the surface having the opening portion open thereto, and to coat and harden UV bonding agent is on the portions having the parts more in front than the narrower portions of the holes for use of bonding agent positioned on the side face portions of the frame, because, in this way, the front cap can be arranged and fixed in high precision, particularly firmly fixed with ease so as not to allow the position to deviate forward and backward in the liquid discharging direction.

Also, it is preferable to give a water treatment to the surface of the front cap having the opening portion open thereto by means of Teflon-coating in particular, because with this treatment, the adhesion of liquid to the discharge surface can be avoided.

The head cartridge in this case is characterized in that it comprises a liquid discharge head unit thus structured, and a liquid containing portion for containing the liquid to be supplied to the liquid discharge head unit.

Also, the method for manufacturing a liquid discharge head unit in this case comprises the following steps of:

manufacturing a supporting member provided with an installation reference used for the positioning reference for the installation on a liquid discharge apparatus main body, liquid supply paths formed inside for conducting liquid, liquid supply ports communicated with the liquid supply paths, being open to the side portion;

manufacturing a chip unit provided with discharge energy generating elements for heating the liquid to be bubbled and discharged, discharge ports for discharging the liquid, and liquid receiving ports for receiving the liquid into the inside thereof;

connecting the chip unit to the supporting member in a state of abutting against the side portion of the supporting member to enable the liquid supply ports and the liquid receiving ports to be communicated, and arranging to be in the relative positions designated for the installation reference;

manufacturing a front cap having an opening portion to enable the discharge ports to be exposed to the outside, being configured to cover the chip unit and the supporting member by covering at least the surface having the discharge ports open thereto; and connecting the front cap to the chip unit and the supporting member in a state of covering the chip unit and the supporting member, and being arranged to be in the relative positions designated for the installation reference.

Further, this method comprises the following steps of:

coating UV bonding agent, before the front cap is arranged on the designated position, on the portions of the side faces of the frame having each portion more in front of the narrower portion of the hole for use of the bonding agent at the time of being arranged on the designated position by use of the front cap provided with the hole for use of the bonding agent on the face on the side of the surface having the opening portion open thereto, being extended from the rear edge portion forwardly in the direction toward the surface having the opening portion open thereto, and having the narrower portion on the way near the front edge portion thereof;

arranging the front cap, after this coating, on the designated position; and irradiating, after this arrangement, ultraviolet rays to the UV bonding to be hardened through the hole for use of UV bonding agent.

BRIEF DESCRIPTION OF THE DRAWINGS

FIG. 1A is an exploded perspective view, and FIG. 1B is a perspective view which shows the assembled state of the liquid discharge head unit.

FIG. 4A is the side view; FIG. 4B is the rear side view; and FIG. 4C is the bottom view.

DETAILED DESCRIPTION OF THE PREFERRED EMBODIMENTS

Hereinafter, with reference to the accompanying drawings, the description will be made of the embodiments in accordance with the present invention.

Figure 1A:
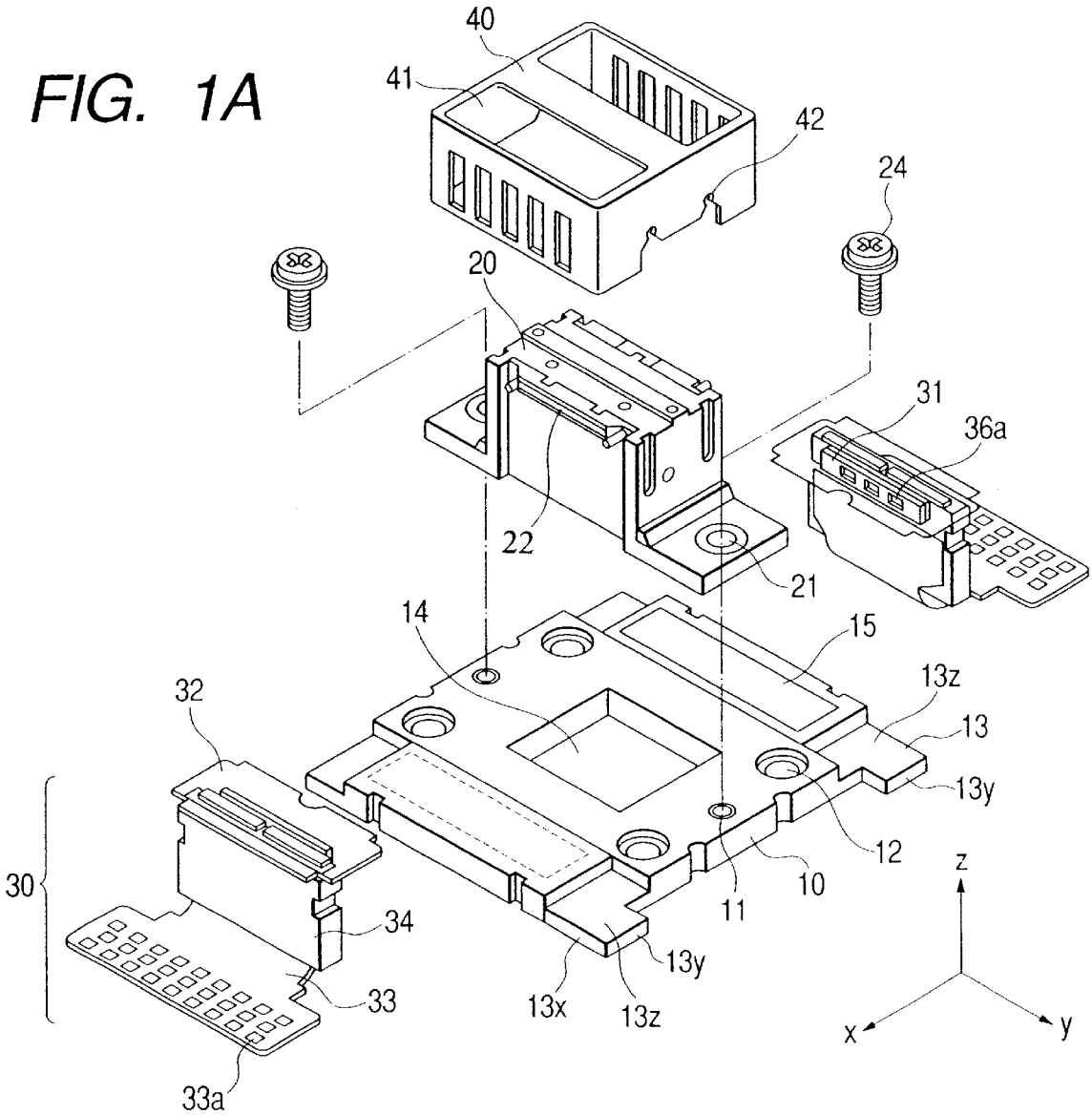
FIGS. 1A and 1B are perspective views which schematically illustrate a liquid discharge head unit in accordance with one embodiment of the present invention.
Figure 1B:
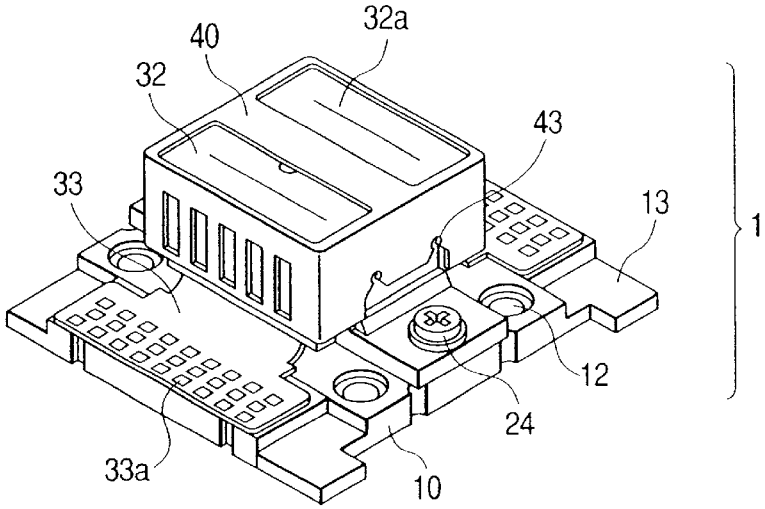
Figure 2:
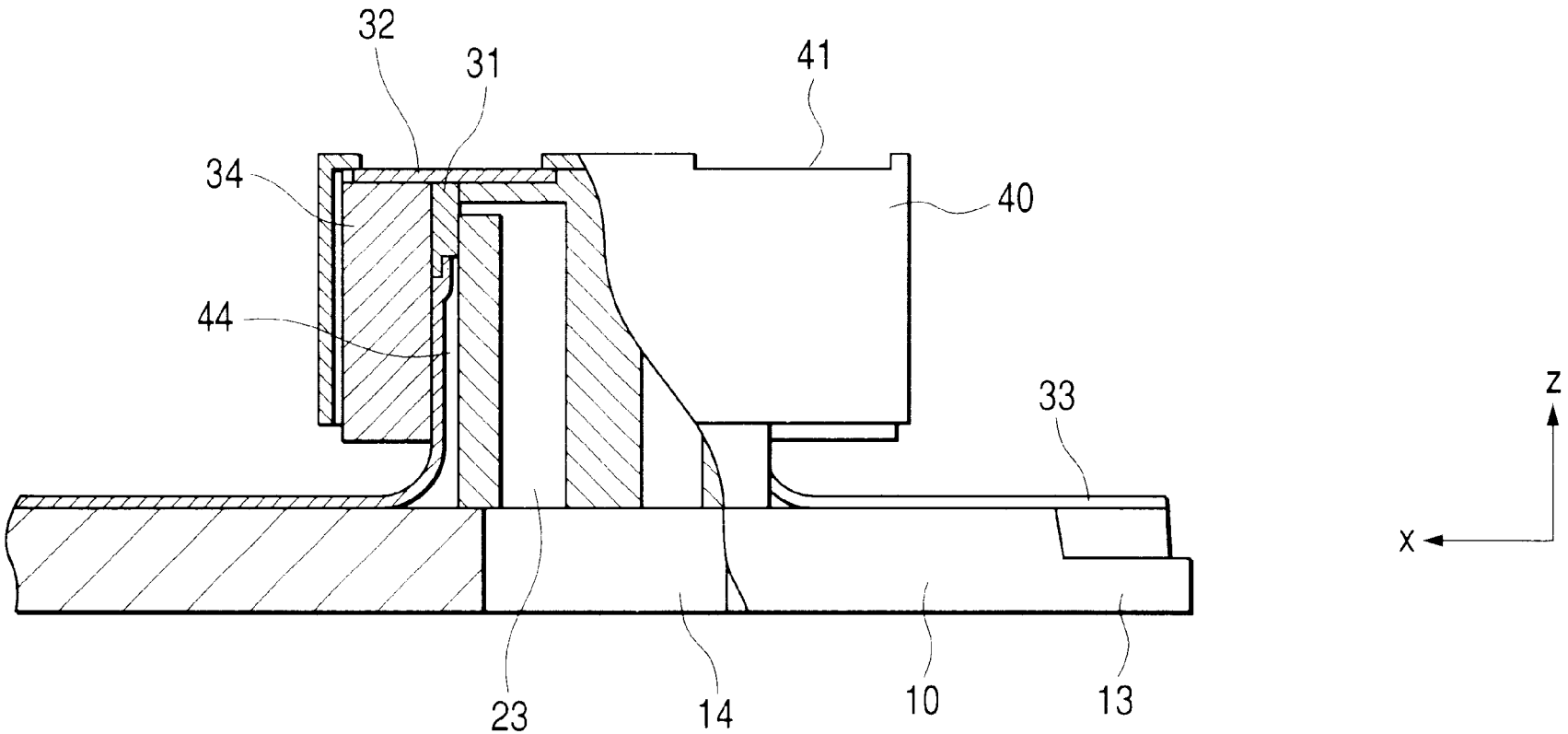
FIG. 2 is a partially broken sectional front view which shows the liquid discharge head unit represented in FIGS. 1A and 1B.
Figure 3B:
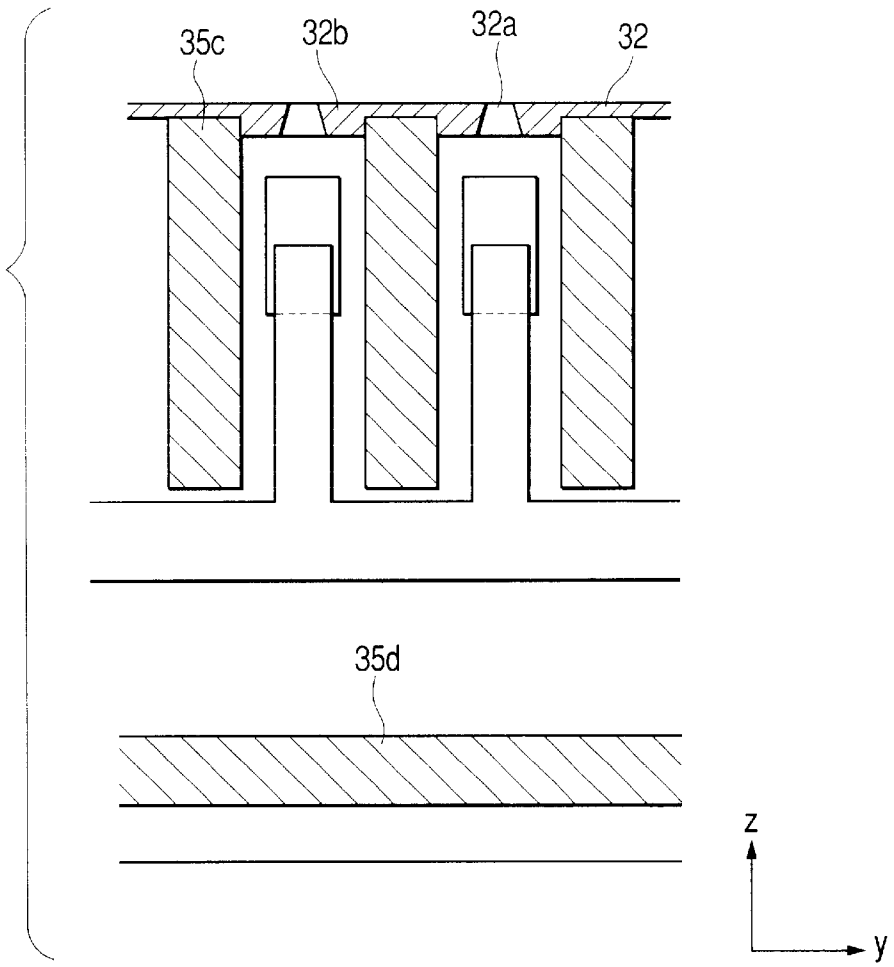
FIGS. 3A and 3B are cross-sectional views which schematically illustrate the liquid discharge head chip portion of the liquid discharge head unit represented in FIGS. 1A and 1B.
Figure 3A:
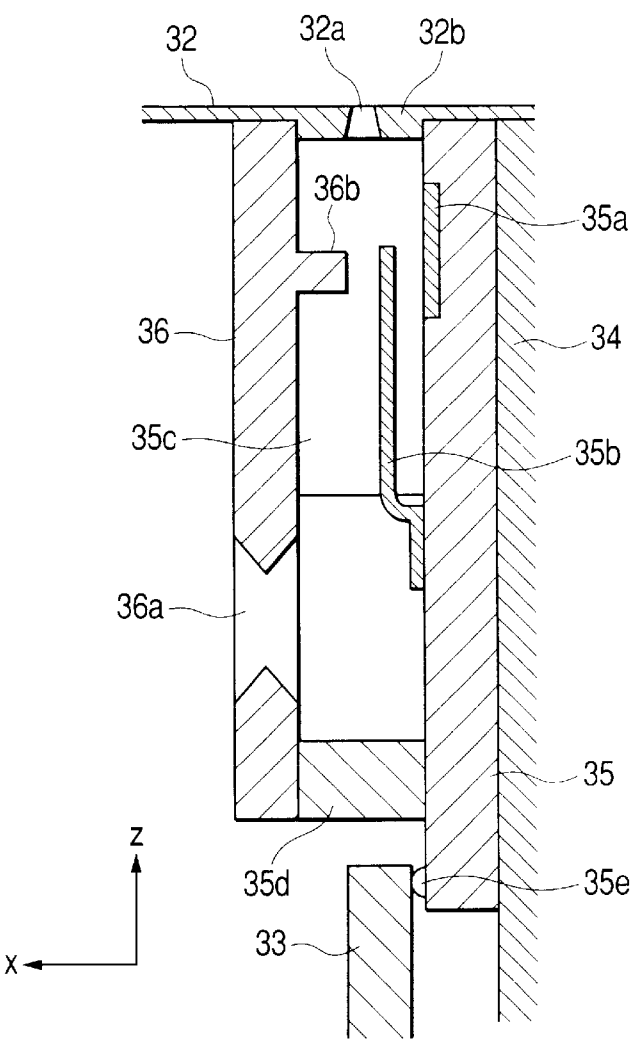

FIGS. 1A and 1B are perspective views which schematically illustrate a liquid discharge head unit 1 in accordance with the present embodiment of the present invention; FIG. 1A is an exploded perspective view, and FIG. 1B is a perspective view which shows the assembled state of the liquid discharge head unit. FIG. 2 is a partially broken sectional front view which shows the liquid discharge head unit 1. FIGS. 3A and 3B are cross-sectional views which schematically illustrate the liquid discharge head chip portion 31.

The liquid discharge head unit 1 is provided with the aluminum base plate 10 which is the base of the entire body; the ceramic frame 20 which stands straightly on the center of the base plate, and fixed to be in the T-letter form when observed from the front; two chip units 30 each installed by being bonded to both side faces, respectively; and a stainless steel front cap 40 bonded to cover above the frame 20 and the two chip units 30.

The base plate 10 has portions which are made lower by one step each at the four corners on the upper surface thereof. Of the portions thus made lower, two of them on the front side are extended slightly toward the front and side faces to serve as the main body installation reference 13. In other words, the edge face of the installation reference 13 extended to the left serves as the installation reference 13*x* in the direction X, and the edge face extended to the front serves as the installation reference 13*y* in the direction Y, and the upper face thereof serves as the installation reference 13*z* in the direction Z. These are processed in each designated surface precision, respectively, and used for positioning references of the liquid discharge unit 1 with respect to the main body. On the base plate 10, installation holes 12 are open to penetrate the base plate 10 on the four corners on the portion which is made higher by one step for use of the head cartridge installation which will be described later. On the central portion of the base plate 10, an opening portion 14 is open in which the liquid supply portion of the head cartridge is inserted. On the positions front and rear of this opening, screw holes 11 are provided for receiving the screws 24 which are used for installing the frame 20.

For the frame 20, the plate type installation member is arranged with the frame installation holes 21 each being open by penetrating the front and rear of the central portion that extends upward. The frame 20 is fixed to the base plate 10 by tightening the screws 24 to engage with the screw holes 11 of the base plate 10 through the frame installation holes 21. In the central portion of the frame 20, at least two liquid supply paths 23 are arranged to be extended upward from the lower face and communicated with the liquid supply ports 22 which are open to the left and right faces, respectively. The opening portion on the lower face of the liquid supply path 23 is positioned in the opening portion 14 of the base plate 10. The chip unit 30 is bonded to and installed on the side face portion of the frame 20 where the liquid supply port 22 is arranged.

The chip unit 30 comprises the liquid discharge head chip 31 that performs liquid discharges; the flexible cable 33 which is electrically connected with the liquid discharge head chip to transmit driving signals; and the alumina base plate 34 that supports them.

The liquid discharge head chip 31 comprises a plurality of heaters (discharge energy generating elements) 35*a* that heat liquid to be bubbled, which are formed in plurality lines at designated intervals, and a heater board 35 having electric wiring (not shown) formed to transmit signals to the heaters 35*a*. On the heater board 35, there are formed the flow path walls 35*c* that form side walls of liquid flow paths running on each of the heaters 35*a*, and the liquid chamber walls 35*d* that form the side walls of the common liquid chamber for supplying liquid to each of the liquid flow paths. Then, the ceiling plate 36 formed by Si is adhesively bonded to the side walls. On the ceiling plate 36, the liquid receiving ports 36*a* are penetratingly open to be communicated with the common liquid chamber. On the portion of the heater board 35, which extends downward to the outer side of the liquid chamber, the bump 35*e* are arranged, to which the flexible cable 33 is electrically connected.

On the upper edge portion of the liquid flow paths formed by the heater board 35 and the ceiling plate 36, there is bonded an orifice plate 32 having open thereon the discharge ports 32*a* which are communicated with each of the flow paths. The orifice plate 32 has a good water repellency so as not to impede liquid discharge by allowing liquid to adhere to and reside on the liquid discharge surface. On the bonding face of the orifice plate 32, extrusions 32*b* are formed corresponding to each of the liquid flow paths and fitted into each of them. With the provision of the extrusions 32*b* of the kind, it becomes possible to position the liquid flow paths and the discharge ports 32*a* in good precision. Further, the bonding strength of the orifice plate 32 can be intensified.

In each of the liquid flow paths, the SiN movable member 35*b* is formed with the movable portion which is supported in the cantilever fashion above the heater 35*a* with a designated clearance so that it can be displaced by the pressure to be exerted by the generation of bubbles. For the ceiling plate 36, the displacement regulating member 36*b* that regulates the displacement of the movable member 35*b* is formed to extrude into the liquid flow path so as to be arranged with a designated clearance from the movable portion of the movable member 35*b*. With the provision of the movable member 35*b* and the displacement regulating member 36*b* thus arranged, it becomes possible to obtain such advantage as to effectively conduct the pressure exerted by the bubbles generated by heater 35*a* to the discharge port 32*a* side for the efficient discharges of liquid, among some others.

The liquid discharge head chip 31 and the flexible cable 33 are bonded onto the base plate 34 to structure the chip unit 30. Then, the chip unit 30 is bonded to both sides of the frame 20 by use of bonding agent so as to enable the liquid receiving port 36*a* of the liquid discharge head chip 31 and the liquid supply port 22 of the frame 20 to be communicated. The bonding agent is not coated on the surface of the liquid discharge head chip 31 where the liquid receiving port 36*a* is open. The bonding agent is coated on the faces on both sides of this surface, and the locations other than the face where the side face of the frame 20 having the liquid supply port 22 is provided therefor is arranged. For the chip unit, there are arranged the one that discharges black color on one side, and three that discharge three colors, yellow, magenta, and cyan, respectively, on the other side. For the head chip that discharges ink of three colors, the common liquid chambers and the liquid receiving ports 36*a* are provided separately for use of each color.

For the flexible cable 33, the contact pad 33*a* is formed on the edge portion on the side opposite to the edge portion connected with the liquid discharge head chip 31, which is electrically connected with the main body side. The flexible cable 33 is structured by forming printed wires on the TAB (Tape Automated Bonding) tape, which is flexible and bent on the portion extended downward along the base plate 34. Thus, the edge portion having the contact pad 33*a* formed is arranged to be positioned on the upper face of the base plate 10 where the flexible cable is bonded by use of hot melt sheet 15.

For the front cap 40, the opening portion 41 is provided on a position above the orifice plate 32 to be narrower than the orifice plate 32, and the edge of the opening portion 41 of the front cap 40 is positioned above it so that the four sides of the orifice plate 32 are not exposed. On the upper face of the front. cap 40, Teflon-coating is applied for the provision of almost the same water repellency as the orifice plate 32. On the front and rear faces of the front cap 40, holes 42 are provided for use of UV bonding agent. Each of the holes 42 for use of UV bonding agent extends from the lower face of the front cap 40 with the width which becomes narrow locally on the way in the vicinity of the upper end portion thereof, and configured to be circular having the larger width than that of the narrow portion at the leading end side thereof. In the circular portion at the upper end of the hole 42 for use of UV bonding agent, the UV bonding agent 43 is applied and solidified. In this manner, even if load is given, the front cap 40 is not allowed to move up and down, because the solidified UV bonding agent 43 is hooked by the upper edge and the narrow portion of the circular portion of the hole 42 for use of UV bonding agent. The front cap 40 is fixed further by means of the sealant 44 which is injected between the frame 20 and the chip unit 32.

As described above, the front cap 40 covers the circumference of the orifice plate 32. Also, it extrudes upward more than the orifice plate 32, and fixed firmly in such state. With the provision of the front cap 40 thus arranged, it becomes possible to prevent the orifice plate 32 having discharge ports 32*a* therefor from being damaged or deformed by the external force to produce unfavorable effect on the preciseness of the liquid discharges. The Teflon-coating applied to the upper face of the front cap 40 has a high durability so that the water repellency is not easily lost even if external force is slightly given, and that the deterioration is also smaller as the time elapses.

Figure 4C:
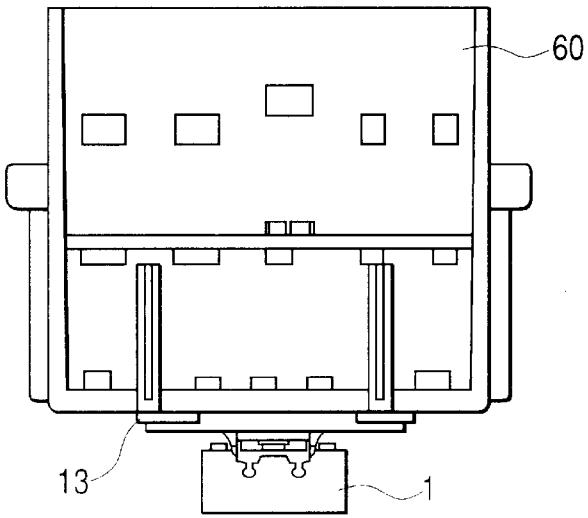
FIGS. 4A, 4B, and 4C are views which schematically illustrate the head cartridge embodying the present invention.
Figure 4A:
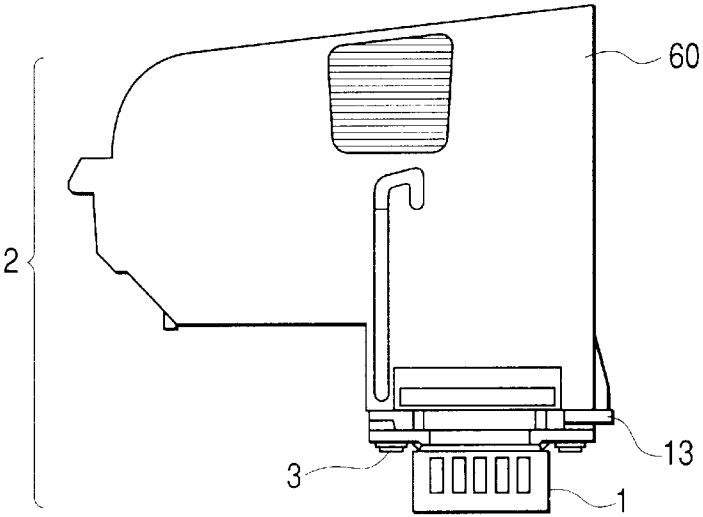
Figure 4B:
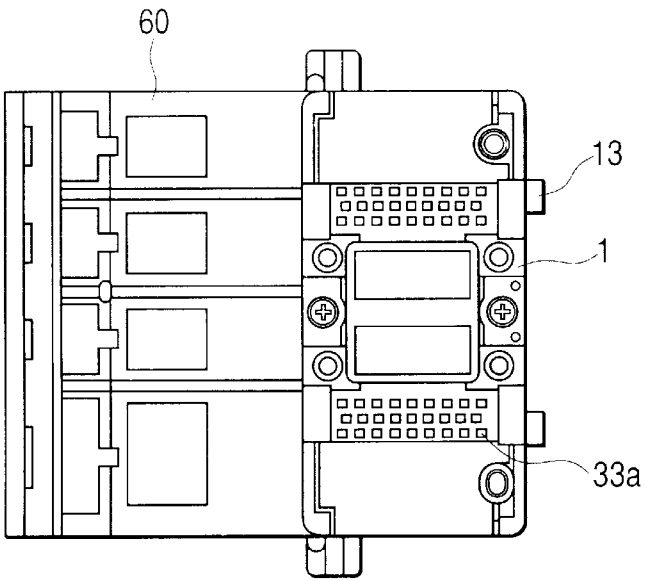
Figure 5:
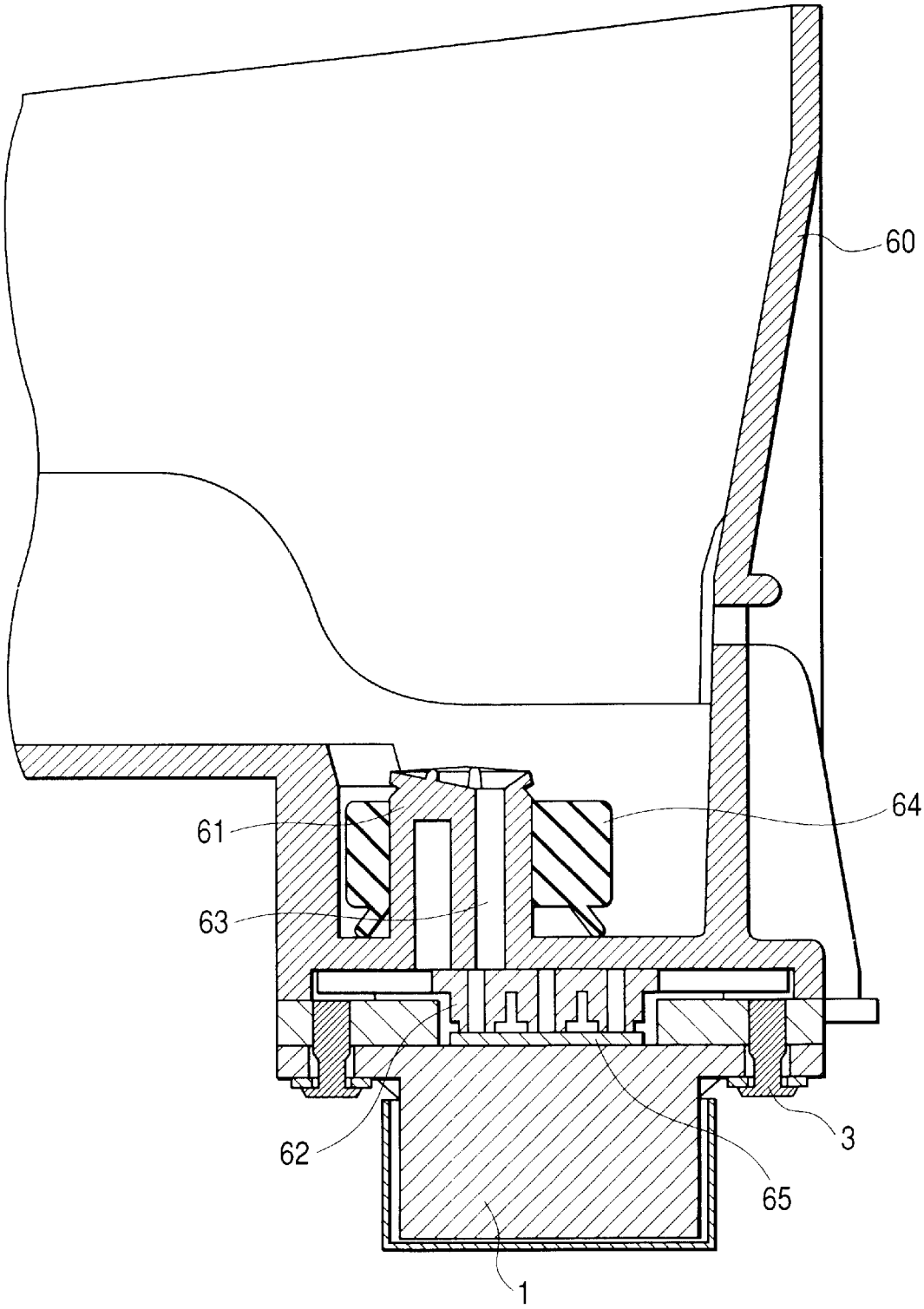
FIG. 5 is a cross-sectional view which shows the fixing unit portion of the liquid discharge head unit of the head cartridge represented in FIGS. 4A to 4C.

The liquid discharge head unit 1 is mounted on the head cartridge 2 as schematically shown in FIGS. 4A to 4C and FIG. 5. FIG. 4A is the side view of the head cartridge 2; FIG. 4B is the rear side view; and FIG. 4C is the bottom view. FIG. 5 is a cross-sectional view which shows the fixing unit portion of the liquid discharge head unit 1 of the head cartridge 2.

The head cartridge 2 is provided with the liquid container holder 60 which detachably holds a liquid container (not shown) to retain liquid to be supplied to the liquid discharge head unit 1. The liquid container holder 60 is configured to be a box having the opening on the upper face thereof, and is able to hold inside each container retaining ink of three colors, yellow, magenta, and cyan, respectively, and a slightly larger container that retains black ink. On the bottom of the liquid container holder 60, a joint portion 61 is arranged to be connected with the liquid supply portion of each liquid container. For the joint portion 61, a sealing rubber 64 is installed to prevent liquid from being evaporated from this portion. Inside the joint portion 61, liquid inlet paths 63 are provided. Each of the liquid inlet paths 63 is communicated with the interior of the liquid supply portion 62 which is arranged to extrude to the lower face of the liquid container holder 60. For the liquid supply portion 62, plural liquid inlet paths 63 are open corresponding to the opening portions of the liquid supply paths 23 of the liquid discharge head unit 1.

The liquid discharge head unit 1 is connected with the lower face of the liquid container holder 60 by screws 3 so that the frame 20 and the liquid supply portion 62 of the liquid container holder 60 are in contact having between them the joint sealing member 65 formed by elastic material, which is provided with through holes in the positions corresponding to the opening portion of the liquid supply path 23 of the frame 20, as well as the opening portion of the liquid inlet path 63 of the liquid supply portion 62. The contacting portion having the joint sealing member 65 inclusively intervened between the frame 20 and the liquid supply portion 62 is positioned substantially in the center of the four-screw holding locations, and when the four screws 3 are tightened, the joint sealing member 65 is effectively tightened to communicate the liquid inlet paths 63 of the liquid container holder 60 and the liquid supply paths 23 of the liquid discharge head unit 1 in good condition.

The liquid discharge apparatus having such head cartridge 2 mounted thereon is used for a printer or the like that forms images by discharging ink to be impacted on a recording medium. The head cartridge 2 is mounted on the carriage of the liquid discharge apparatus main body. Then, the carriage holds the head cartridge 2 in a position where the discharge ports 32*a* face the recording surface of a recording medium with a designated clearance, and enables it to move on the recording surface. When the head cartridge moves, the heaters 35*a* are driven at designated timing to discharge ink to be impacted on the designated positions on the recording medium.

When the head cartridge 2 is mounted on the carriage, the installation reference 13 of the head cartridge 2 abuts against the positioning reference portion of the carriage. Then, the head cartridge 2 is positioned and mounted on the carriage in high precision. With the head cartridge 2 being positioned and mounted on the carriage, the contact pads 33*a* which are exposed on the lower face of the head cartridge 2 abuts against the contact points on the main body side to enable the head cartridge to be electrically connected with the main body side. By way of this portion, the reception and transmission of signals, such as signals to drive the heaters 35*a*, are effectuated.

For the liquid discharge apparatus described above, there is provided means for removing ink and dust particles adhering to the liquid discharge surface by the long-time use. As such means, it is generally practiced to enable the blade which is formed by elastic material to be in contact with the liquid discharge surface for wiping, that is, to use means for removing ink and dust particles by relatively moving the liquid discharge head unit 1 and such blade.

For the liquid discharge head unit 1 of the present embodiment, the front cap 40 arranged for the liquid discharge surface has the opening portion 41 narrower than the orifice plate 32 as described earlier, and covers the orifice plate 32 so as not to allow the four sides thereof to be exposed. In this manner, it becomes possible to prevent the blade from being hooked by the sides of the orifice plate 32 so that no force is exerted to peel off the orifice plate 32. Also, on the upper face of the front cap 40, the water repellent treatment is given by use of Teflon-coating as described earlier. As a result, the outer circumference having the water repellent treatment acts and conducts the ink which has been wiped off by wiping to the outside of the liquid discharge surface, thus enhancing the capability to expel ink at the time of wiping operation. In this respect, with the front cap 40 being installed to be expanded upward more than the orifice plate 41, there occurs portions where blade cannot easily be in contact with the orifice plate 32 directly around the edge of the opening portion 41, but the opening portion 41 is made sufficiently large so that the edge of the opening portion 41 is not allowed to be positioned near the discharge ports 32*a*. In this way, it becomes possible to keep ink away from the discharge ports 32*a* to the extent that it does not affect liquid discharges from the discharge ports 32*a*.

Next, with reference to FIGS. 6A to 6F, 7A to 7D, 8A and 8B, the description will be made of a method for manufacturing a liquid discharge head unit.

Figure 6A:
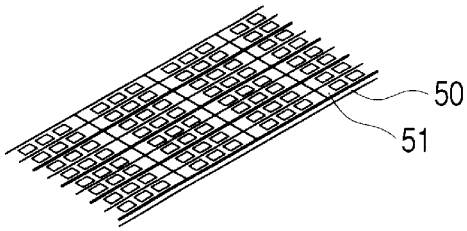
FIGS. 6A, 6B, 6C, 6D, 6E and 6F are perspective views which schematically illustrate each step of a method for manufacturing the chip unit of the liquid discharge head unit represented in FIGS. 1A and 1B.

FIGS. 6A to 6F are perspective views which schematically illustrate the manufacturing steps of the chip unit 30. At first, there are bonded as shown in FIG. 6A the heater board element plate 50 having heaters 35*a*, movable members 35*b*, flow path walls 35*c*, and liquid chamber walls 35*d* formed for a plurality of chip portions thereon, and the ceiling plate element plate 51 having liquid receiving ports 36*a* and displacement regulating portions 36*b* formed for a plurality of chip portions thereon. This bonded member is cut off by use of dies or the like and separated into each chip. In this manner, many numbers of chips are manufactured efficiently.

Figure 6B:
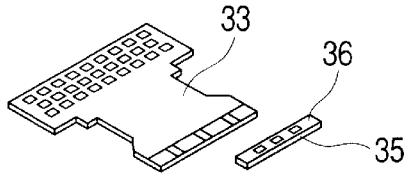
Figure 6C:
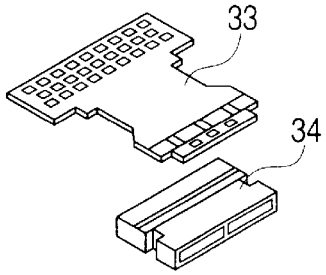
Figure 6D:
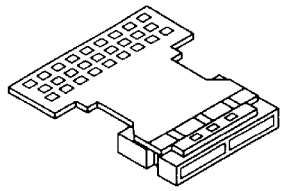

Next, as shown in FIGS. 6B and 6C, the flexible cable 33 is arranged on the bumps 35*e*of the heater board 35, and the flexible cable 33 and the heater board 35 are bonded by fusing the bumps 35*e*. Then, as shown in FIG. 6C and FIG. 6D, the heater board 35 and the flexible cable 33 are bonded onto the base plate 34.

Figure 6E:
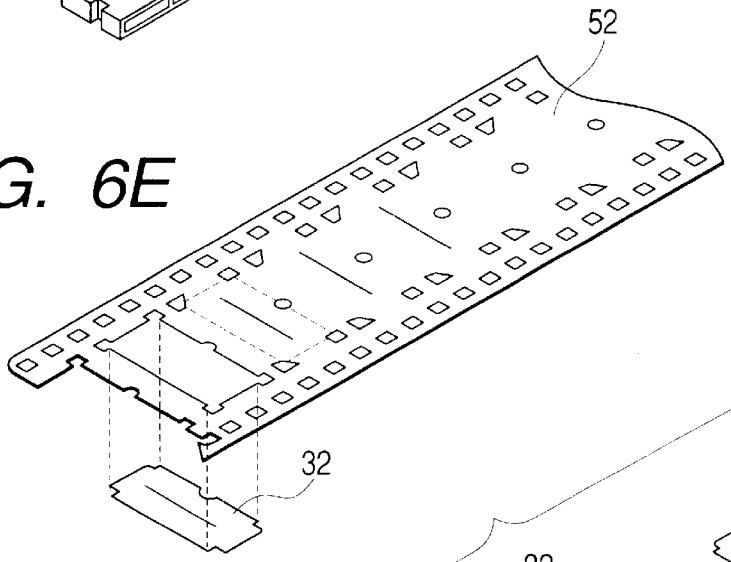

Next, the orifice plate 32 is produced from the OP sheet (sheet for use of the orifice plate) 52 arranged in the tape form as shown in FIG. 6E. In other words, the OP sheet 52 on the tape is conveyed through the laser processing device and the cutting device in that order, and the discharge ports 32*a* are open by use of the laser device, while forming the extruded portions 32*b*, and then, cut into the designated shape by use of the cutting device to produce the orifice plate 32. In this way, many numbers of orifice plates 32 are produced efficiently. At this juncture, a mask having the portions of 100%, 30%, and 0% transmittances formed in the designated patterns, respectively, is used for the laser processing. Thus, the discharge ports that penetrate the OP sheet 52 are formed by the laser beams that transmit the portion of the mask having 100% transmittance, and the thickness of the OP sheet 52 are cut to be thin to a certain extent by the laser beams that transmit the portion having 30% transmittance. Then, the extrusions 32*b* are formed relatively between the thinner portions and the portions which are not cut at all, corresponding to the portions of 0% transmittance.

Figure 6F:
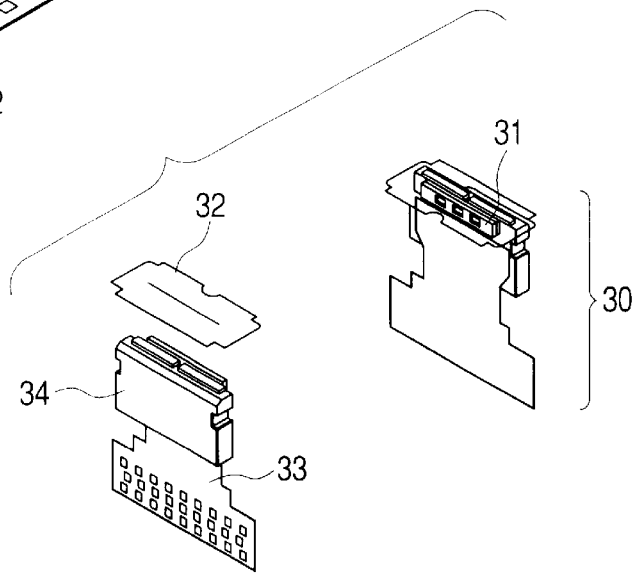

Subsequently, as shown in FIG. 6F, the orifice plate 32 is bonded to the opening surface of the liquid flow paths formed by the heater board 35 and the ceiling plate 36, hence completing the manufacture of the chip unit 30. At this juncture, the extrusions 32*b* are formed on the orifice plate 32. Therefore, with the extrusions 32*b* being inserted into the liquid flow paths, respectively, it becomes easy to position the discharge ports 32*a* with respect to the liquid flow paths in good precision. Also, it becomes possible to prevent the bonding agent used for this bonding from flowing into the liquid flow paths, hence avoiding any adverse effect to be produced on the discharge precision, which may otherwise take place if the bonding agent is allowed to flow into the liquid flow paths.

FIGS. 7A to 7D, 8A and 8B are perspective views which schematically illustrate the assembling steps of the base plate 10, the frame 20, the chip unit 30, and the front cap 40.

The frame 20 is formed by burning ceramic material put into a mold. After burning, it is removed from the mold and machined for minute adjustment. Particularly, the faces which abut against the base plate 10, the chip unit 30, and the front cap 40, the face which abuts against the liquid container holder 60 through the joint sealing member 65, and the faces which become the installation references in the directions 13*x*, 13*y*, and 13*z*, respectively, are machined each to be in the designated high precision. In this case, since ceramic material having small thermal expansion is used for the frame 20, the amount of expansion is small even if processing heat is generated by machining, thus making it possible to perform a highly precise machining. In this respect, it is preferable to provide dummy holes (not shown) for the interior of the frame 20 to be formed by burning ceramic material as described above. With the provision of dummy holes, the thermal deformation that may take place when being burned is absorbed by the dummy hole portion to avoid the creation of warping. The frame 20 of the present embodiment is in the form of essentially symmetrical on the left and right sides. It is therefore desirable to provide the left and right dummy holes equally.

Figure 7A:
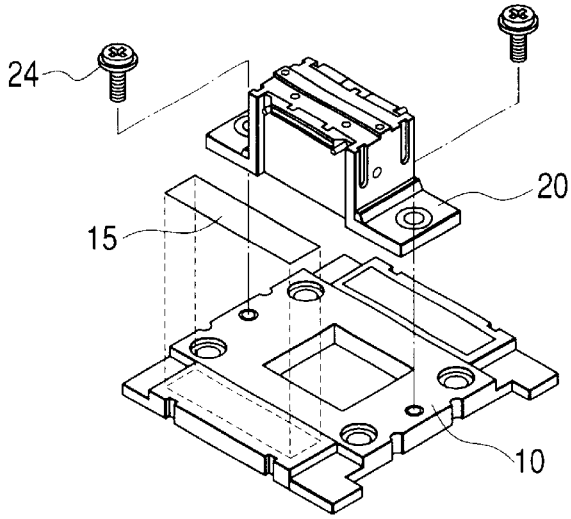
FIGS. 7A, 7B, 7C and 7D are perspective views which schematically illustrate each step of the method for manufacturing the chip unit of the liquid discharge head unit represented in FIGS. 1A and 1B.
Figure 7B:
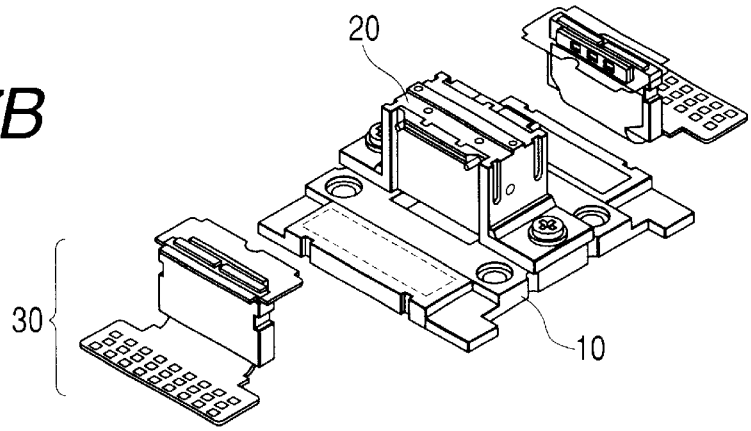

The frame 20 thus formed is arranged on the base plate 10 formed In a designated shape by means of press processing as shown in FIGS. 7A and 7B, and fixed by use of screws 24. At this juncture, the frame 20 is arranged to be positioned and fixed in high precision so that, as a reference, the distance from the installation reference 13*x* in the direction X and the installation reference 13*y* in the direction Y to the reference point of the frame 20 presents a designated distance defined as the installation reference 13. The fixation is conducted by use of screws 24. Therefore, the distance from the installation reference 13*x* in the direction X and the installation reference 13*y* in the direction Y to the reference point of the frame 20 should be measured after fixation, and if the distance is not within the designated range, it is possible to remove the screws 24 and try this connection again.

On the upper face of the base plate 10, the hot melt sheet 15 is arranged on the left- and right-hand sides of the position where the frame 20 should be arranged.

Figure 7C:
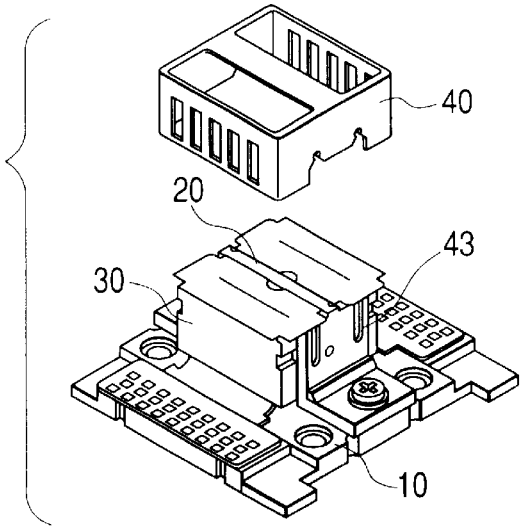

Next, as shown in FIGS. 7B and 7C, two chip units 30 are adhesive bonded to the faces on both side of the frame 20 by use of bonding agent. For this bonding, the bonding agent is coated on the faces other than the face of the liquid discharge head chip 31 where the liquid receiving port 36*a* is open, and the side face of the frame 20 where the liquid supply port 22 is open, and then, bonding is effectuated. At this juncture, the positioning in the left and right directions (direction X) of the chip unit 30 is conducted by enabling the face of the liquid discharge head chip 31 where the liquid receiving port 36*a* is open and the portion of the side face of the frame 20 where the liquid supply port 22 is open to be in contact without any intervention of bonding agent. Thus, with the face of the liquid discharge head chip 31 where the liquid receiving port 36*a* exists, and the side face of the frame 20 being fixed by the contact thereof without using any bonding agent, it becomes possible to position and fix the liquid discharge head chip 31 in good precision with respect to the frame 20. For positioning the chip unit 30 in the forward and backward directions (direction Y), the distance between the discharge port on the outermost edge of the chip unit 30 and the reference 13*y* of the base plate 10 in the direction Y is measured, and the relative positions of the chip unit 30 and the frame 20 is adjusted so as to set this distance at the designated one. Also, for positioning the chip unit 30 in the top to bottom direction (direction Z), the relative positions are adjusted likewise so that the distance between the upper face of the orifice plate 32 of the chip unit 30 and the reference 13*z* in the direction Z should become the designated one.

For the flexible cable 33, the portion where the contact pads 33*a* are formed therefor is positioned to the base plate 10, and bonded by fusing the hot melt sheet 15.

The front cap 40 is formed by processing stainless steel. Then, Teflon-coating agent is blown in a thickness of 10 $\mu$m to the surface of the front cap 40 where the orifice plate 32 is arranged. After that, heating is given at a temperature of 300 to 400° C. to bake it for Teflon-coating. For the present embodiment, stainless steel is used for the front cap 40. Thus, thermal deformation or the like does not occurs, and the Teflon-coating can be provided with high water repellency and high durability in good condition.

Figure 7D:
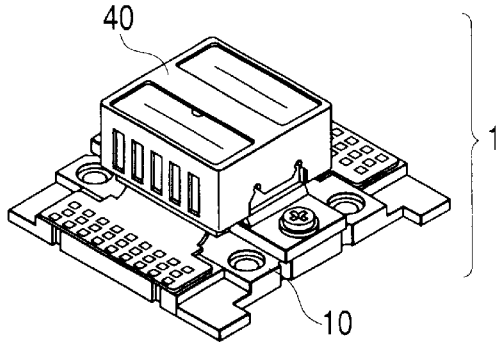

Next, as shown in FIG. 7C and FIG. 7D, the front cap 40 is positioned to cover the frame 20 and the upper portion of the chip unit 30 bonded to both side faces thereof, and fixed by use of UV bonding agent 43. At this juncture, the UV bonding agent 43 is at first coated provisionally in the position where the front cap 40 is arranged in the circular portion at the upper end of the hole 42 for use of the UV bonding agent. Then, the front cap 40 is arranged so that each of the distances from the installation reference 13*x* of the installation reference 13 in the direction X and the installation reference 13*y* in the direction Y to the corresponding side faces of the front cap 40 becomes the designated distance, respectively, and that the distance from the installation reference 13*z* in the direction Z to the upper face of the front cap 40 becomes the designated distance. While keeping this status, UV rays are irradiated to UV bonding agent 43 through the hole 42 for use of UV bonding agent in order to harden the bonding agent for fixation. In this way, the front cap 40 can be positioned and fixed in good precision. In this respect, it is desirable to position the front cap 40 in a state where the air is being blown by use of a blower so that no dust particles are allowed to enter between the orifice plate 32 and the front cap 40.

Figure 8A:
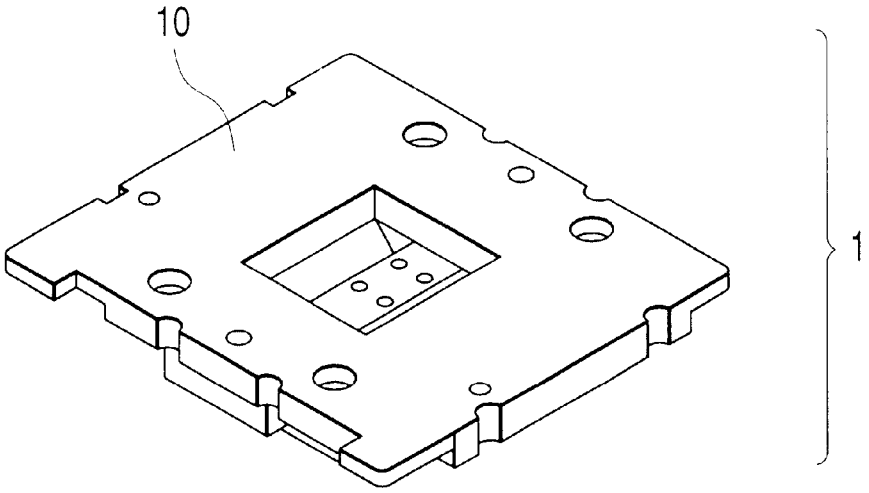
FIGS. 8A and 8B are perspective views which schematically illustrate each of the steps after those shown in FIGS. 7A to 7D.
Figure 8B:
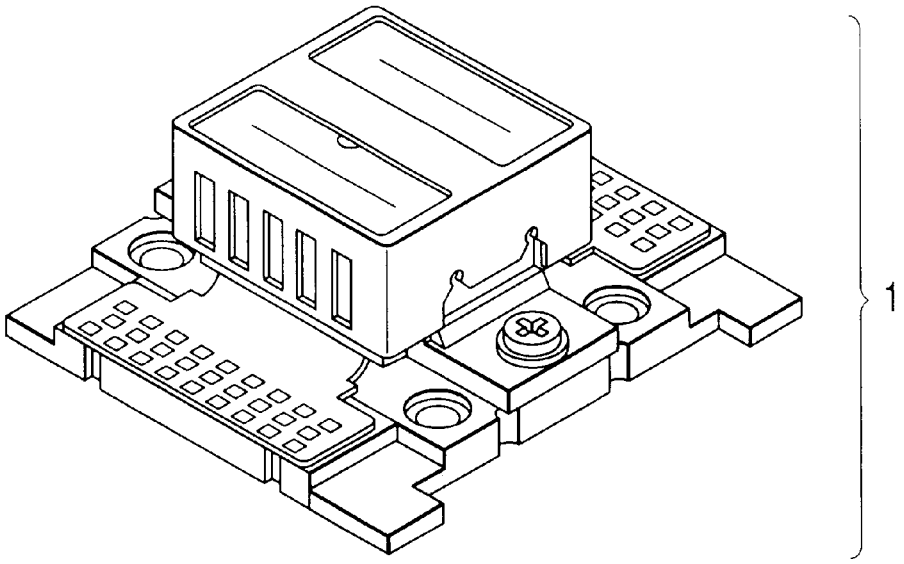

Next, as shown in FIG. 8A, the liquid discharge head unit 1 is reversed, and sealant 44 is injected from the opening portion 14 side of the base plate 10. The sealant 44 runs through the sealing grooves provided for the frame 20 and the chip unit 30 and flows around and solidified between the frame 20, and the chip unit 30 and front cap 40. In the steps described above, the liquid discharge head unit 1 is completed as shown in FIG. 8B.

For the liquid discharge head unit 1 of the present embodiment, it is possible to bond the frame 20 on the base plate 10 by enabling the frame to abut against the base plate 10 to be positioned in high precision with respect to the installation reference 13 within a plane parallel to the abutting face, and further, to bond the chip unit 30 easily by enabling it to abut against the side face of the frame 20 formed to provide a highly precise surface to be positioned in high precision with respect to the installation 13 within in a plane parallel to the abutting face. As a result, the chip unit 30, namely, the discharge ports 32*a* of the liquid discharge head chip 31, is positioned in high precision with respect to the installation reference 13. The installation reference 13 is used for positioning the head cartridge 2 mounted on the liquid discharge head unit 1 on the main body side of a liquid discharge apparatus. Therefore, if the discharge ports 32*a* are positioned in high precision with respect to this installation reference 13, it is meant to enable the discharge ports 32*a* to be positioned in high precision with respect to the main body, hence making it possible to enhance the positional precision of the liquid discharges from the liquid discharge apparatus, and enhance the preciseness of recorded images accordingly.

Further, it is also possible to position the front cap 40 in high precision with the installation reference 13 of the base plate 10 as the reference therefor for the arrangement and bonding thereof. Then, with the front cap 40 positioned exactly above the side of the orifice plate 32, it become s possible to protect the orifice plate 32 from the external force that may be given thereto. Also, in the direction Z, positioning is executed in good precision to make it possible to prevent the front cap 40 from being in contact with a recording medium to be arranged on the position f acing the liquid discharge surface when liquid is discharged so as not to disturb recorded images, among some others.

Also, for the present embodiment, orifice plates 32 are provided for two liquid discharge chips 31 each individually. Therefore, there is no possibility that the relative positions of the discharge ports 32*a* of the two liquid discharge head chips 31 are caused to be displaced due to the thermal expansion of the orifice plates 32 unlike the case where an orifice plate is formed integrally with the two liquid discharge head chips 31. As a result, it is possible to prevent the formation of images from being disturbed by the deviation of impact portions of ink discharged from the two liquid discharge head chips 31.

Also, for the liquid discharge head unit 1 of the present embodiment, the frame 20 is provided with the function as means for holding the chip unit 30 at a designated position, and the liquid supply paths 23 are formed inside at the same time to carry function as means for supplying liquid to the chip unit 30. As a result, as compared with the case where means for holding the chip unit 30 and means for supplying liquid separately, the number of parts needed for the liquid discharge head unit 1 can be reduced to manufacture the head unit in a smaller size with ease.

For the present embodiment, ceramic material is used as the material of the frame 20. The ceramic material has a small amount of thermal expansion to make machining possible in high precision in good condition. Also, with the ceramic material used as the material of the frame 20, the amount of deformation is small even if heat generated by operating the liquid discharge head chip 31 is added, thus maintaining liquid discharges in high precision. Also, ceramic material has a good resistance to ink. Therefore, it is preferable to use ceramic material as the material of the frame 20. Here, however, the material is not necessarily limited thereto.

Also, as the material of the base plate 10, aluminum is used. The base plate 10 serves as the fixing portion of the frame 20, and also, serves as the part that becomes the fixing portion when installed to the liquid container holder 60 or to a liquid discharge apparatus main body. Therefore, it is preferable to use a very strong aluminum for providing a sufficient durability, but the material of the base plate 10 is not necessarily limited to aluminum. For the two chip units 30, the structure is shown so as to mount one for discharging black ink, and the other for discharging color ink, but it may be possible to mount both of them for discharging black ink.

In this respect, the liquid discharge head unit of the present invention is characterized in that the front cap 40 is provided to cover the side portions of the liquid discharge surface of the orifice plate 32 in particular, and that in this manner, function is obtained to protect the orifice plate 32. The orifice plate 32 can be arranged in the relative positions designated for the installation reference formed for the supporting member of the chip unit 30, and then, with the provision of the front cap 40 in such a manner, it becomes possible to obtain good effect particularly in protecting the orifice plate 32 or the like. For the preferable structure to provide such front cap 40, it is not necessarily to arrange the structure with the base plate 10, the frame 20, and the chip unit 30. It may be possible to arrange the structure by the supporting member having the base plate 10 and the frame 20 integrally formed therefor, and the chip unit 30. With the structure thus arranged, it is also possible to manufacture the liquid discharge head unit having the discharge ports 32*a* positioned in high precision with respect to the installation reference by bonding the chip unit 30 to the supporting member so as to arrange it in the relative positions designated for the installation reference formed for the supporting member.

As described above, in accordance with the present invention, the frame can abut against the base plate to be connected to the base plate in a state where the frame is arranged in the relative positions designated for the installation reference, and further, the chip unit can abut against the side portion of this frame to be connected to the frame in a state of being arranged in the relative positions designated for the installation reference, hence making it possible to structure the liquid discharge head unit in which the chip unit is positioned and arranged in high precision with respect to the installation reference. The installation reference is also used for the arrangement of the liquid discharge head unit. Therefore, the discharge ports open to the chip unit can be arranged in high precision with respect to the main body, thus enabling the preciseness of liquid discharges to be enhanced.

Also, with the provision of the front cap connected to cover the discharge port formation surface, having the opening portion to enable the discharge ports to be exposed, it becomes possible to protect the liquid discharge surface from the external force that may be exerted when the liquid discharge head unit is installed on a head cartridge or on the main body or in some other cases. As a result, it is possible to prevent the discharge port formation member from being deformed by external force, among some other damages, so as not to produce any adverse effect on the preciseness of liquid discharges.

What is claimed is:

1. A liquid discharge head unit, comprising:

a base plate having an installation reference used as a positioning reference for the installation thereof on a liquid discharge apparatus main body;

a frame connected to said base plate, having liquid supply paths formed therein for conducting liquid, and liquid supply ports communicated with said liquid supply paths open to a side portion;

a chip unit provided with discharge energy generating elements for heating said liquid to be bubbled and discharged, discharge ports for discharging said liquid, and liquid receiving ports for receiving said liquid into the interior thereof, and connected to said frame in a state of abutting against the side portion of said frame so as to enable said liquid supply ports and said liquid receiving ports to be communicated; and a front cap having an opening portion to enable said discharge ports to be exposed to the outside, being arranged to cover said chip unit and said frame by covering at least the surface having said discharge ports open thereto, and connected to said chip unit and said frame, wherein on side face portions of the surface of said front cap having said opening open thereto, holes for use of a UV bonding agent are arranged with narrower portions of said holes formed on the way near the front edge portions, and extended forwardly from the rear edge portion of said frame in the direction toward the surface having said opening portion open thereto, and the UV bonding agent is coated and hardened on the portions having the parts more in front than said narrower portions of said holes for use of the UV bonding agent positioned on the side face portions of said frame.

2. A liquid discharge head unit comprising:

a supporting member provided with an installation reference used as a positioning reference for installation on a liquid discharge apparatus main body;

liquid supply paths formed inside for conducting liquid;

liquid supply ports communicating with said liquid supply paths, and open to a side portion;

a chip unit provided with discharge energy generating elements for heating the liquid to be bubbled and discharged, discharge ports for discharging the liquid, and liquid receiving ports for receiving the liquid, said liquid supply ports and said liquid receiving ports being connected to communicate with each other in a state of abutting against the side portion of said supporting member, and a front cap having an opening portion to enable said discharge ports to be exposed to an exterior of said head unit, being arranged to cover said chip unit and said supporting member by covering at least a surface through which said discharge ports open, and being connected to said chip unit and said supporting member, wherein said chip unit is provided with a flat type orifice plate through which said discharge ports open, connected to an opposite portion of said chip unit, an opening portion being smaller in size than said orifice plate, and said front cap covers above side face portions of said orifice plate, and wherein on the side face portions of the surface of said front cap having said opening open thereto, holes for use of a UV bonding agent are arranged with narrower portions of said holes formed on the way near the front edge portions, and extended forwardly from the rear edge portion of said frame in the direction toward the surface having said opening portion open thereto, and the UV bonding agent is coated and hardened on the portions having the parts more in front than said narrower portions of said holes for use of the UV bonding agent positioned on the side face portions of said frame.

* * * * *

UNITED STATES PATENT AND TRADEMARK OFFICE

CERTIFICATE OF CORRECTION

PATENT NO. : 6,530,641 B2
APPLICATION NO. : 09/941776
DATED : March 11, 2003
INVENTOR(S) : Tetsuya Ohashi et al.

It is certified that error appears in the above-identified patent and that said Letters Patent is hereby corrected as shown below:

COLUMN 9

Line 45, "front." should read --front--;.

COLUMN 11

Line 60, "35*e*of" should read --35e of--.

COLUMN 12

Line 59, "In" should read --in--.

COLUMN 14

Line 45, "become s" should read --becomes--; and
Line 50, "f acing" should read --facing--.

Signed and Sealed this

Twenty-ninth Day of August, 2006

JON W. DUDAS
*Director of the United States Patent and Trademark Office*